US005203193A

United States Patent [19]

Iguchi et al.

[11] Patent Number: 5,203,193

[45] Date of Patent: Apr. 20, 1993

[54] METHOD OF ROLLING H-BEAMS

[75] Inventors: Takaaki Iguchi; Hiroyuki Hayashi, both of Chiba, Japan

[73] Assignee: Kawasaki Steel Corporation, Kobe, Japan

[21] Appl. No.: 787,126

[22] Filed: Nov. 4, 1991

[30] Foreign Application Priority Data

Nov. 5, 1990 [JP] Japan ..... 2-297163
Nov. 30, 1990 [JP] Japan ..... 2-330621

[51] Int. Cl.[5] ..... B21B 1/08
[52] U.S. Cl. ..... 72/225; 72/366.2
[58] Field of Search ..... 72/224, 225, 365.2, 72/366.2

[56] References Cited

U.S. PATENT DOCUMENTS 4,958,509 9/1990 Kusaba et al. ..... 72/225
5,085,065 2/1992 Onderka et al. ..... 72/8

FOREIGN PATENT DOCUMENTS 0126311 9/1980 Japan ..... 72/225
59-202101 11/1984 Japan .
61-5601 1/1986 Japan .
0289502 11/1989 Japan ..... 72/225
1-317607 12/1989 Japan .
2-80102 3/1990 Japan .
2-84203 3/1990 Japan .
0147102 6/1990 Japan ..... 72/225
2-147112 6/1990 Japan .

*Primary Examiner*—Lowell A. Larson
*Assistant Examiner*—Thomas C. Schoeffler
*Attorney, Agent, or Firm*—Oliff & Berridge

[57] ABSTRACT

A method of producing H-beams is carried out by rolling a rough rolled steel billet having a web and flanges by a universal finishing mill having a pair of vertical rolls embracing the flanges of the billet on both sides and a pair of horizontal rolls having widths less than those in the rough rolling and embracing the web on upper and lower sides to reduce the web width and thicknesses of the flanges of the billet and to correct inclination of the flanges, thereby reducing and adjusting an inner web width of the H-beam. The billet is finish-rolled in a state such that the axes of the pair of vertical rolls are shifted onto the downstream side of the axes of the pair of horizontal rolls into an area including a zone where the web width and the thicknesses of the flanges are simultaneously reduced. In another aspect, the billet is rolled by the universal finishing mill whose pair of vertical rolls are positively driven.

6 Claims, 14 Drawing Sheets

METHOD OF ROLLING H-BEAMS

BACKGROUND OF THE INVENTION

This invention relates to a method of rolling H-beams or wide flange beams by universal mills, which is advantageously used in case of continuously producing H-beams while keeping a constant web width in spite of wear of the rolls used in rolling, or producing various H-beams different in size with the same rolling installation.

In general, H-beams are produced by hot rolling steel blanks 5, 6 or 7 having various cross-sections as shown in FIGS. 2*a* to 2*c* in a line including a breakdown mill 1, a universal roughing mill 2, an edger mill 3 and a universal finishing mill 4 which are arranged progressively downstream of the flowing of the steel blanks as shown in FIGS. 1*a* and 1*b*.

The blanks (slab 5, rectangular billet 6 and H-beam billet 7) shown in FIGS. 2*a* to 2*c* are first roughly rolled to predetermined shapes in the breakdown mill 1. The breakdown mill 1 used in this case is usually composed of a pair of upper and lower caliber rolls having open passes 8 or closed passes 9 as shown in FIGS. 3*a* and 3*b*. In rolling in the breakdown mill 1, the steel blanks are rolled successively through a plurality of passes of the caliber rolls in plural passes to be rolled into shapes suitable for later intermediate rolling processes The steel blanks thus rolled are intermediately rolled in at least one universal roughing mill 10 having rolls of shapes shown in FIG. 4*a* and at least one edger mill 11 having rolls of shapes shown in FIG. 4*b* in one pass or plural passes. The steel blanks are then rolled in a universal finishing mill 12 having rolls of shapes shown in FIG. 4*c* usually in one pass to H-beam steel products. Therefore, sizes of rolls of the finishing universal mill 12 and the rolling mills upstream thereof are determined depending upon the size of the products. The rolls are so designed that distance (a) in FIG. 3*a* and distances (b), (c) and (d) in FIGS. 4*a*, 4*b* and 4*c* are substantially equal to each other.

In rolling for producing H-beams, variation in shape of blanks particularly after breakdown rolling is limited as described above. In the case that a particular series of H-beams (for example, H 600×300) are pro practice to use horizontal rolls having particular widths suitable for the H-beams.

The H-beams rolled by such horizontal rolls having the particular widths (for example, the width (d) in FIG. 4*c*) have substantially constant inner web widths. On the other hand, roll gaps between the horizontal rolls and between vertical rolls must be changed in order to roll one series of section steels of several kinds having different thicknesses by the use of the same rolls without exchanging them. In this case, the difference between the maximum and minimum thicknesses of flanges of the rolled H-beams becomes, for example, as much as approximately 16 mm. As the outer web width is an inner web width plus thicknesses of two flanges, the outer web width varies within 32 mm which is twice 16 mm.

It is unavoidable to produce a series of H-beams including those of various outer web widths in the rolling methods of the prior art described above. If such H-beams are used as building or construction beams, there are the following problems.

In the event that building or construction beams are made by joining a series of H-beams of several sizes, when the H-beams including those of various outer web widths are arranged so that outer surfaces of one flanges of the respective H-beams are in a plane, outer surfaces of the other flanges of the H beams are located unevenly with difference in height of twice the difference in thickness of the flanges. Such an unevenness provides a great problem to be solved in constructing the building or construction beams.

In designing structures of buildings, dimensions are usually determined successively from outside to inside of the structure. Therefore, such H-beams whose inner web widths are substantially constant but outer web widths are different depending upon thicknesses of flanges of the H-beams encounter a great problem in cases where adjustment of dimensions relative to each other at joined portions of the H-beams must be severely accurate.

In order to avoid the above disadvantages of the H-beams produced by rolling, H-beams made of steel plates by welding have been used particularly for buildings, which are welded to form H-beams having constant outer web widths, even if thicknesses of their flanges are not uniform. However, such welded H-beams are disadvantageous because of high manufacturing cost.

In order to solve the problem of the unevenness of outer web widths of H-beams, a method of adjusting the outer web widths was disclosed in Japanese Patent Application Laid-open No 59-202,101, in which rough rolled billets before finish rolling are rolled to widen their webs by a particular rolling mills having rollers inclined relative to rolling directions and supported by cantilevers (FIGS. 5*a* and 5*b*). In this method, however, the particular rolling mill for widening the webs is needed to increase the installation cost. Moreover, there is a risk of webs to be broken when billets have thin webs.

In order to overcome these problems, a method of reducing outer web widths by vertical rolls of a universal mill was proposed, whose horizontal rolls have widths narrower than inner web widths of H-beams to be produced, as disclosed in Japanese Patent Application Laid-open No. 2-84,203 (FIG. 6). Moreover, a method of reducing outer web widths by a universal mill was proposed, whose vertical rolls are set so as to permit the distance therebetween or roll gap to be less than the width of horizontal rolls plus sum of thicknesses of both flanges and are shifted onto the downstream side relative to the horizontal rolls so as to avoid any interference of the vertical and horizontal rolls with each other, as disclosed in Japanese Patent Application Laid-open Nos. 2-147,102 and 2-147,112 (FIGS. 7*a* and 7*b*). In this case, existing rolls used until now are applicable for carrying out these methods and these rolling mills are not needed to be particularly modified. Therefore, these methods can be readily effected.

With these methods, however, defects of H-beams are often caused such as overlapping at rounded portions, buckling of webs or shifting of webs from center positions, when rolling reduction of the inner web widths is relatively large.

In view of these disadvantages, the inventors of this invention of the present application propose a method of reducing or adjusting inner web widths of H-beams by finish rolling as disclosed in Japanese Patent Application Laid-open No. 2-80,102. In this method, rough rolled billets after breakdown and intermediate rolling are rolled by finish rolling with a finish rolling mill whose horizontal rolls (adjustable width rolls) are set to have roll widths less than those in the rough rolling. As a result, the billets are subjected to the finish rolling to reduce web widths and thicknesses of flanges and to correct inclination of the flanges. In this manner, the web widths are freely adjusted or reduced (FIGS. 8*a* and 8*b*). According to this method, H-beams having constant outer web widths can be effectively produced, even if rolling is applied to billets to modify thicknesses of their flanges. Even in this method, however, the reduction of the outer web widths is limited as explained hereinafter. Therefore, a rolling system has been expected which is able to realize larger reduction of web widths.

In reducing the web widths by setting the roll widths of the horizontal rolls of the finishing mill less than the inner web width of the billet subjected to the rough rolling, the contacting state between the rolls of the rolling mill and the billet is as shown in FIG. 9.

Referring to FIG. 9, as the inner web width $Bw_0$ is reduced by the vertical rolls V, they contact the billet h prior to contacting of the horizontal rolls H with a normal rolling reduction and normal roll diameters so that the web width of the billet h is reduced until end surfaces of the horizontal rolls H contact the billet h. The reduction of the inner web width $Bw_0$ is effected mainly at zones located slightly upstream of zones k where the horizontal rolls contact the web ha of the billet h. On the other hand, before the contact of the horizontal rolls with the web ha of the billet h, roll gaps between the upper and lower horizontal rolls H are more than the thickness of the web ha as shown in FIG. 10*a*. Therefore, buckling or torsion of the web ha may occur as the case may be as shown in FIGS. 10*b* and 10*c*. As the web ha of the billet rolled by rough rolling is rolled to reduce its thickness by the horizontal rolls H, the billet h rolled by finish rolling will be shaped substantially determined by the roll gaps between the upper and lower horizontal rolls H even if buckling occurs before the reduction by the horizontal rolls H. However, upon amending the buckling of the web ha by the reduction caused by the horizontal rolls H, contacting pressure between the web ha and the horizontal rolls H becomes locally higher to cause defects such as flaws or cracks in surfaces of the web ha.

Moreover, the torsion of the web ha as shown in FIG. 10*a* or 10*c* permits the billet to pass through the finishing mill in a condition of longitudinal center lines of the flanges hb shifted from the roll gaps between the horizontal rolls H. Consequently, the web ha of finished product is often shifted relative to the flanges hb in opposite directions or one direction as shown in FIG. 11*a* or 11*b*.

The thinner and wider the webs of billets before finish rolling, these problems are particularly acute. Moreover, when the reduction or adjustment of web widths is larger, the possibility of occurrence of such defects increases.

The thicknesses of webs of billets before finish rolling are determined by appropriate rolling reduction in universal rolling. On the other hand, the inner web widths of billets before finish rolling are substantially equal to inner web widths of billets having the thinnest flange thicknesses in one rolling operation. Therefore, in order to prevent the defects in finish rolling described above, it is necessary to provide a limitation of rolling reduction in one pass according to thicknesses and inner widths of webs. If a required rolling reduction exceeds this limitation, the rolling is required to be divided into two or more passes.

Referring back to the prior art methods described above, the method previously proposed (the Japanese Patent Application Laid-open No. 2-80,102) by the inventors of the present invention is fundamentally different from the other methods (Japanese Patent Application Laid-open Nos. 2-84,203, 2-147,102 and 2-117,112) in the feature of rolling to reduce web widths and substantially at the same time to reduce flange thicknesses. According to the method proposed by the inventors of the present invention, it is possible to make larger the rolling reduction of the flanges than that of the webs in universal finishing process so that surfaces of the webs being rolled are subjected to tensile stresses in rolling directions caused by elongations of the flanges. As a result, it is possible to mitigate the limitation of reduction of webs to a remarkable extent for preventing the buckling of the webs caused by the compression in directions perpendicular to the rolling directions. According to this method, therefore, the rolling reduction or adjustment of web widths can be increased more than three times in comparison with those in the other prior art methods, although the adjustable width horizontal rolls are needed.

However, if a required adjustment of web widths exceeds a limitation, it is necessary for reducing web widths to divide the rolling into plural passes more than two. In the method previously disclosed by the inventors of the present invention in the Japanese Patent Application Laid-open No. 2-80,102, the rolling is carried out to fulfill the condition $\Delta Bwmax = 80\ Tw^2/Bw$, where $\Delta Bwmax$ (mm) is the limit value of rolling reduction of inner web width, $Tw^2$ (mm) is web thickness before being rolled, and Bw (mm) is inner web width. In other words, if a rolling reduction $\Delta Bw$ of inner web widths exceeds the $\Delta Bwmax$ calculated from the above equation, the rolling is divided into more than two passes to limit the rolling reduction per one pass.

However, when the rolling is effected in more than two passes in the finish rolling, the temperature of the steel to be rolled is likely to lower. Such a temperature lowering of the steel often causes not only defects of products in shape such as waved webs and deterioration of product quality but also lowering of production efficiency. It is, therefore, preferable to perform the rolling in one pass. Moreover, it becomes clear that more severe reduction limitations of web widths are often needed in actual rolling operations.

In rolling causing rolling reduction of web widths, buckling and detrimental deformation in section of products can be prevented by arranging restraining means such as web guides on the entrance side of a rolling mill. However, such means do not serve to enlarge the rolling reduction or adjustment per one pass.

In this connection, the rolling reduction or adjustment of the inner web widths can be effected partially in rough rolling processes. However, as large rolling reductions with adjustable width rolls tend to cause stepped surfaces of products, thicknesses of webs cannot be considerably reduced by the rolling. Consequently, an exclusive pass is needed for reduction of web widths so that the number of passes increases and hence to encounter the difficulties described above.

SUMMARY OF THE INVENTION

It is an object of the invention to provide a method of rolling H-beams, which is able to mitigate the limitation of rolling reduction of inner web widths without causing buckling and torsion which are likely to occur in rolling accompanying with rolling reduction of web widths.

In order to accomplish this object, in a method of producing an H-beam by finish rolling a rough rolled steel billet having a web and flanges by a universal finishing mill having a pair of vertical rolls embracing the flanges of the billet on both sides and a pair of horizontal rolls having widths less than those in the rough rolling and embracing the web on upper and lower sides to reduce the web width and thicknesses of the flanges of the billet and to correct inclination of the flanges, thereby reducing and adjusting an inner web width of the H-beams, according to the invention the billet is rolled by the universal finishing mill in the state that the axes of the pair of vertical rolls are shifted onto the downstream side of the axes of the pair of horizontal rolls into an area including a zone where the web width and the thicknesses of the flanges are simultaneously reduced.

In another aspect of the invention, the billet is rolled by the universal finishing mill whose pair of vertical rolls are positively driven.

According to the invention, in reducing or adjusting inner web widths in finish rolling with adjustable width horizontal rolls by positively reducing the web width of a billet normally rolled by rough rolling, limit values of the rolling reduction can be considerably enlarged so that lifetime of the rolls is prolonged and exchange of rolls becomes minimal, thereby improving production efficiency of H-beams by rolling.

The invention will be more fully understood by referring to the following detailed specification and claims taken in connection with the appended drawings.

DESCRIPTION OF THE PREFERRED EMBODIMENTS

A universal mill is usually constructed so that four center axes of a pair of horizontal rolls and a pair of vertical rolls are located in a plane perpendicular to the rolling direction The inventors have performed various experiments and investigation on arrangement of the rolls of rolling mills in rolling accompanied with reduction of web widths of H-beams. As a result, they ultimately found that shifting the vertical or horizontal rolls incorporated in a rolling mill in the rolling direction relative to the horizontal or vertical rolls is very effective in order to enlarge the permissible limitation of rolling reduction of inner web widths. The present invention resides in the above discovery.

In carrying out the invention to produce an H-beam, a steel billet rolled in rough rolling and having a web and flanges is finish rolled by a universal rolling mill to reduce the web width and thicknesses of the flanges of the billet and to correct inclination of the flanges, whereby the inner web width of the billet is reduced or adjusted. The universal mill includes a pair of vertical rolls embracing the flanges of the billet on both sides and a pair of horizontal rolls having widths less than those in the rough rolling and embracing the web on upper and lower sides. According to the method of invention, the rolling is effected in the state that the vertical rolls are shifted onto the downstream side of the horizontal rolls into an area including a zone where the reduction of the web width and the thicknesses of the flanges are simultaneously effected.

Figure 1A:
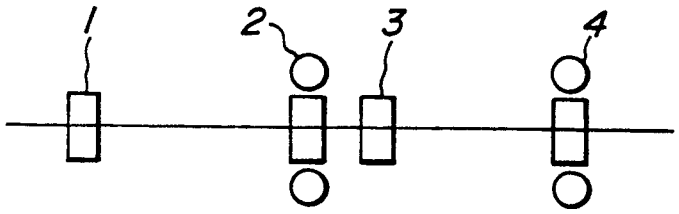
FIGS. 1*a* and 1*b* are schematic views illustrating examples of installations in rolling lines for producing H-beams.
Figure 1B:
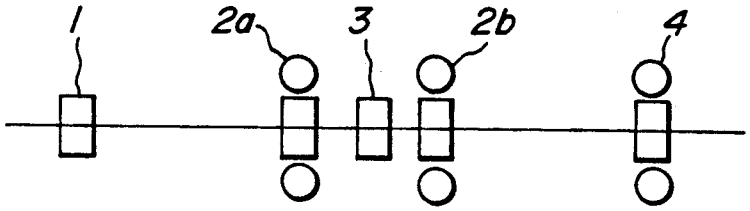
Figure 2A:
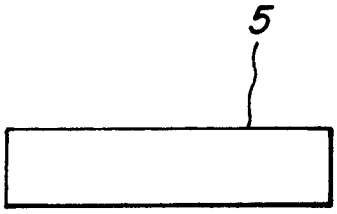
FIGS. 2*a*, 2*b* and 2*c* are views illustrating sections of blank materials of H-beams to be rolled.
Figure 2B:
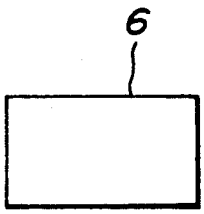
Figure 2C:
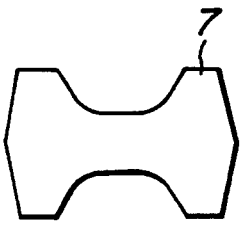
Figure 3A:
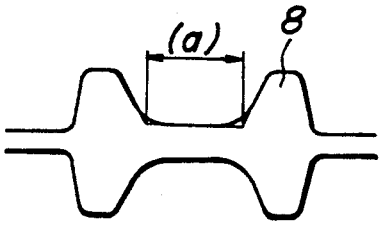
FIGS. 3*a* and 3*b* are views illustrating calibers of rolls of breakdown mills.
Figure 3B:
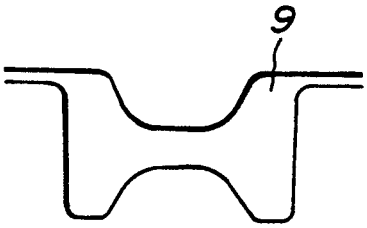
Figure 4A:
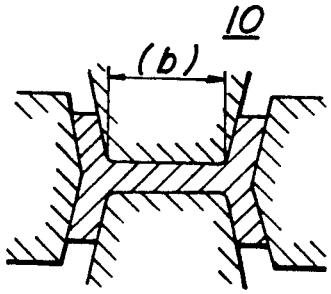
FIG 4a PRIOR ART
FIGS. 4*a*, 4*b* and 4*c* are views illustrating sections of rolls of the prior art used for producing H-beams by rolling.
Figure 4B:
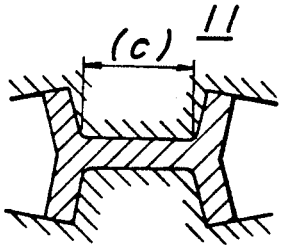
FIG 4b PRIOR ART
Figure 4C:
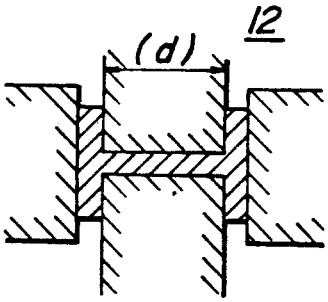
FIG 4c PRIOR ART
Figure 5A:
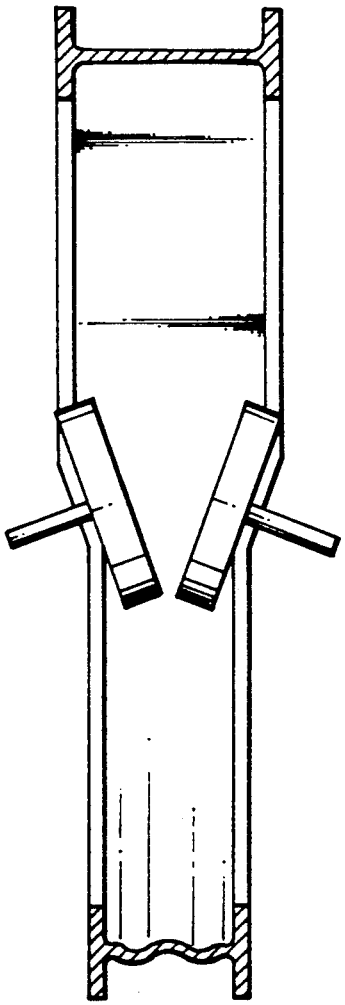
FIG 5a PRIOR ART
FIGS. 5*a* and 5*b*, 6 and 7*a* and 7*b* are schematic views illustrating methods of the prior art.
Figure 5B:
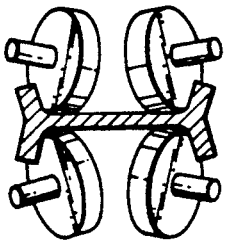
FIG 5b PRIOR ART
Figure 6:
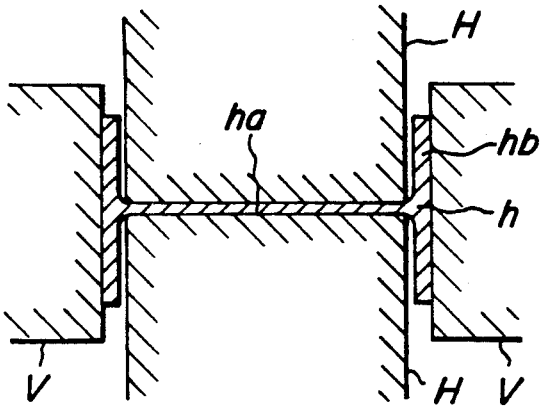
FIG. 6 PRIOR ART
Figure 7A:
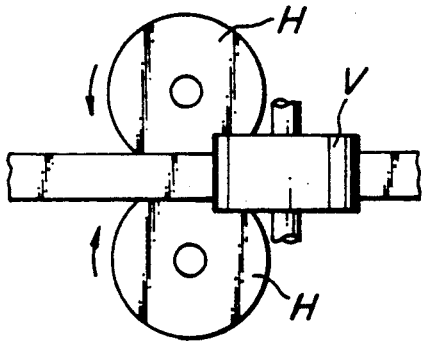
FIG. 7a PRIOR ART
Figure 7B:
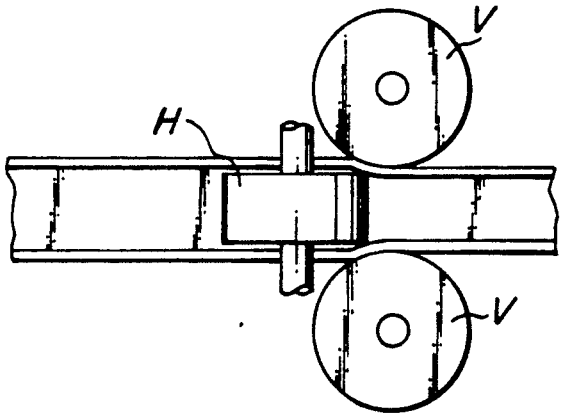
FIG. 7b PRIOR ART
Figure 8A:
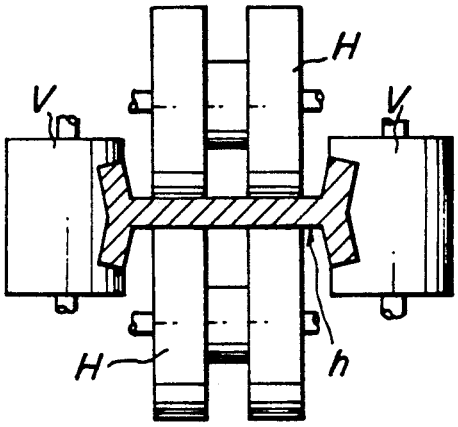
FIG 8a PRIOR ART
FIGS. 8*a* and 8*b* are schematic views showing a method of the prior art.
Figure 8B:
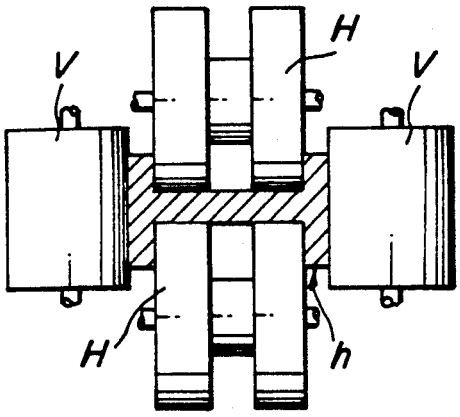
FIG 8b PRIOR ART
Figure 9:
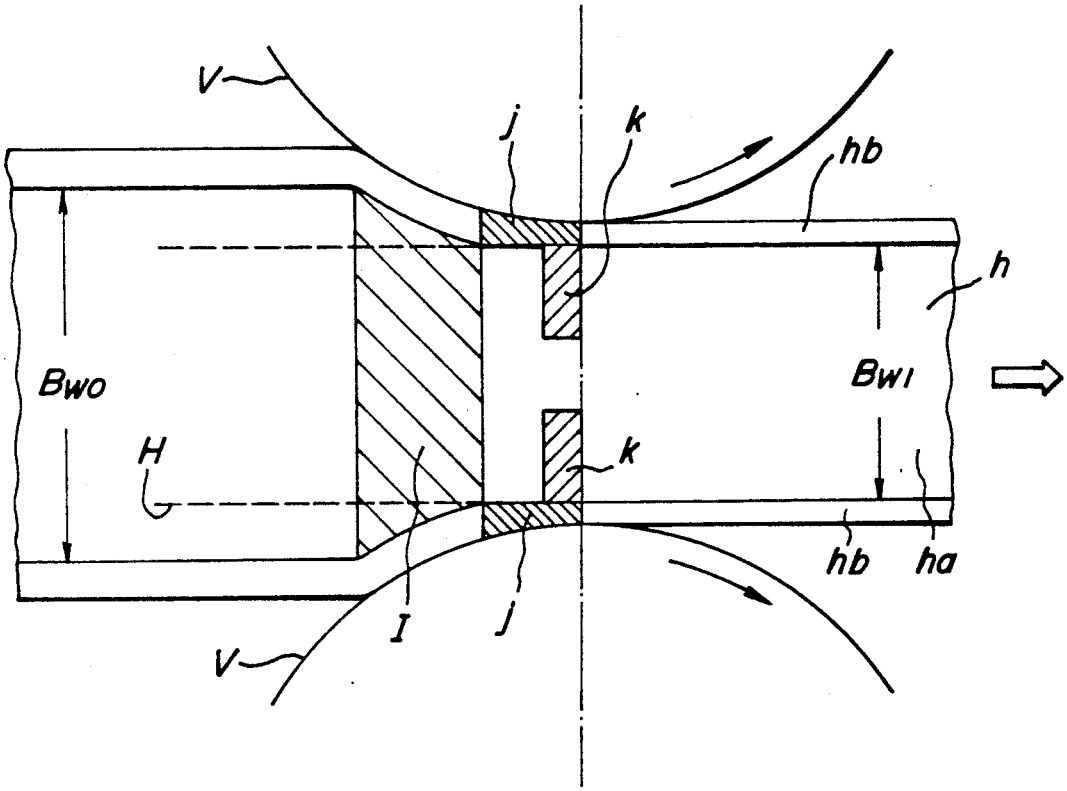
FIG 9 PRIOR ART
FIG. 9 is a view illustrating a contact state between a billet rolled by rough rolling and rolls in the method shown in FIGS. 8*a* and 8*b;*
Figure 10A:
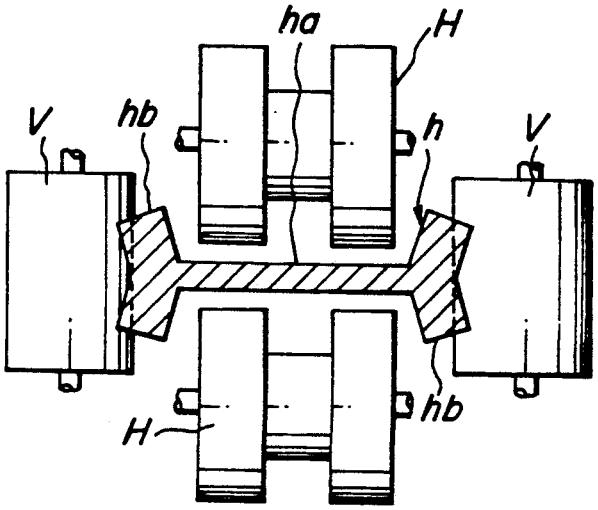
FIG 10a PRIOR ART
FIGS. 10*a*, 10*b* and 10*c* are views for explaining how defects of billets in shape to occur in rolling accompanied with reduction of web widths of H-beams according to the method shown in FIGS. 8*a* and 8*b;*
Figure 10B:
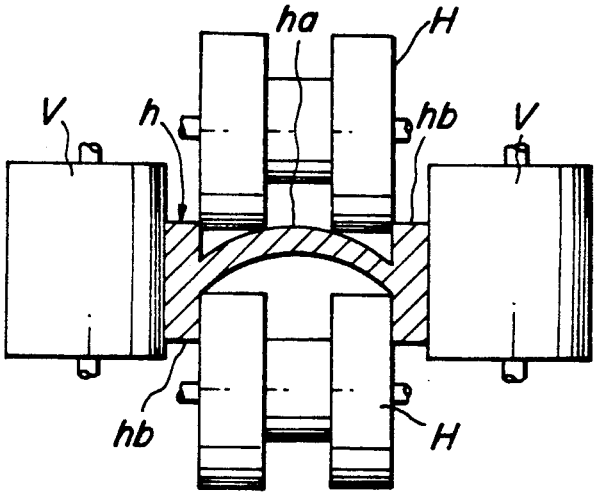
FIG 10b PRIOR ART
Figure 10C:
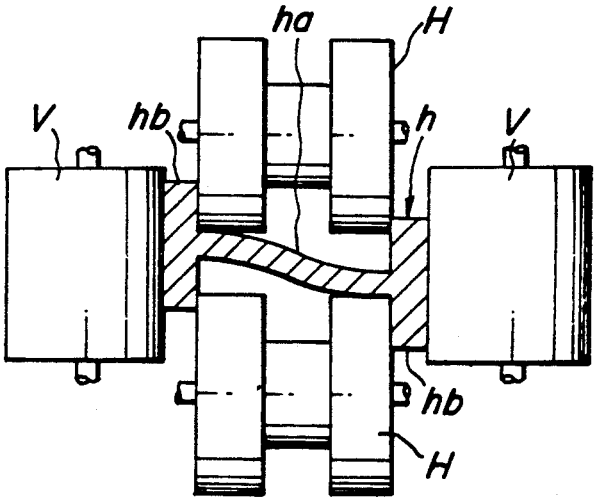
FIG 10c PRIOR ART
Figure 11A:
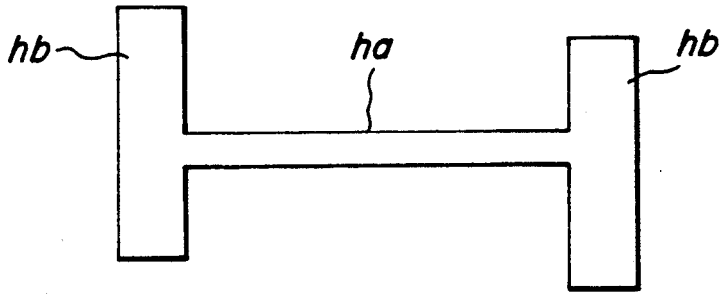
FIG 11a PRIOR ART
FIGS. 11*a* and 11*b* are views showing sections of H-beams produced by an inappropriate rolling.
Figure 11B:
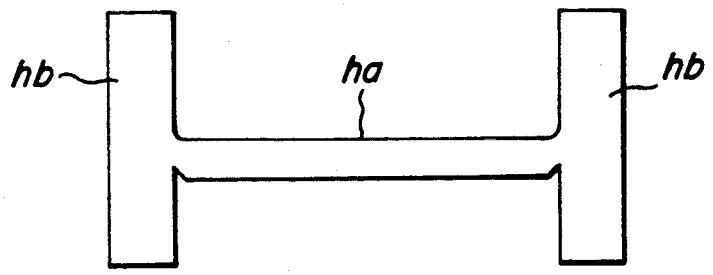
FIG 11b PRIOR ART
Figure 12:
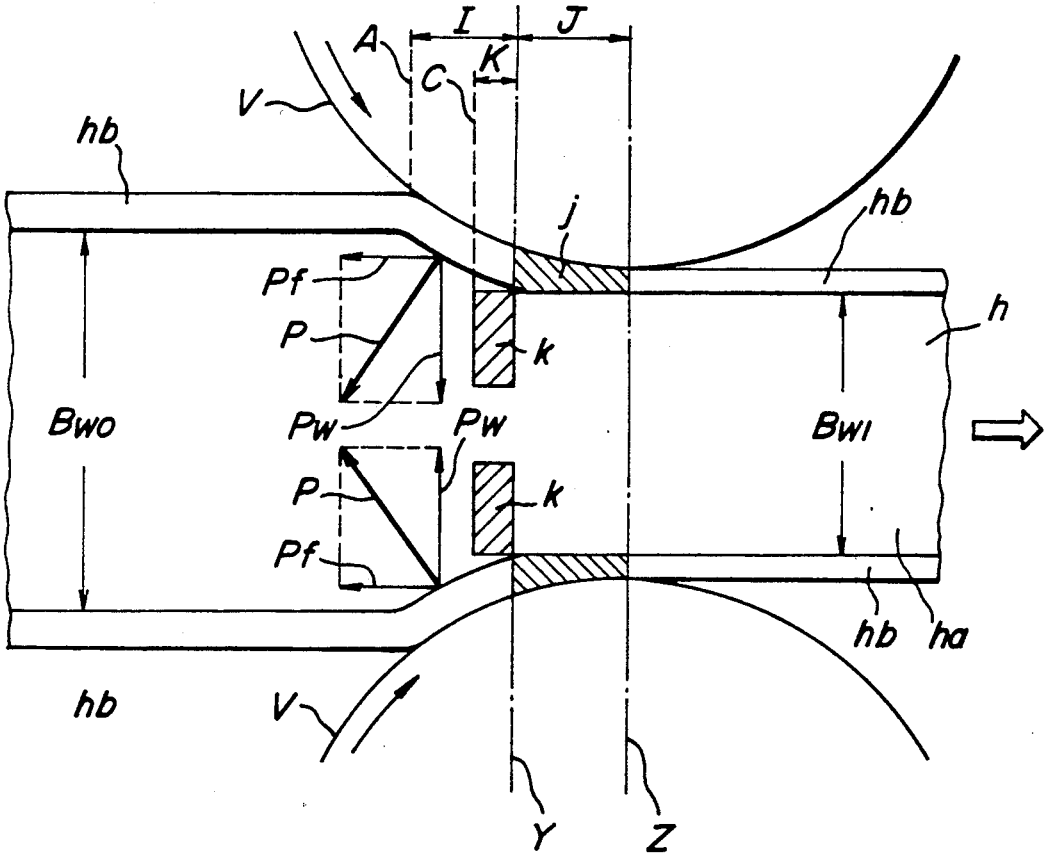
FIG. 12 is an explanatory view for describing the rolling method of producing H-beams according to the invention.
Figure 13:
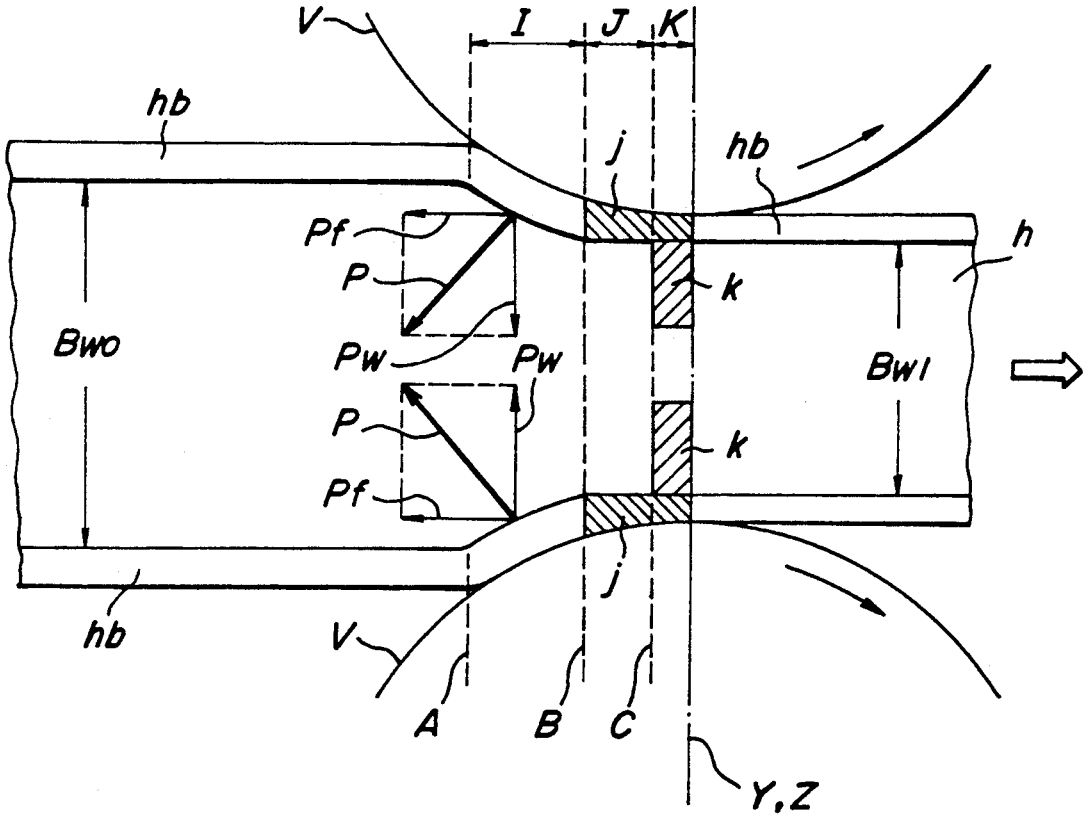
FIG 13 PRIOR ART
FIGS. 13 and 14 are explanatory views of rolling states for producing H-beams according to the prior art.

FIGS. 12 and 13 schematically illustrate contact states between rolls and rough rolled steel billets and reaction forces of vertical rolls acting upon web surfaces in the event that the reduction or adjustment of inner web widths is performed by a universal finishing mill having horizontal rolls of widths less than the inner web widths of the rough rolled steel billet. FIG. 12 illustrates the case that the vertical rolls V are shifted onto the downstream side according to the invention, while FIG. 13 shows the vertical and horizontal rolls whose axes are all in a plane according to the prior art methods.

Assuming that the width of the horizontal rolls is $Bw_1$ which is less than the inner web width $Bw_0$ of the rough rolled billet h rolled by roughing rolling as shown in FIG. 12 illustrating the prior art, the following is the contact state between the flanges hb and the web ha of the billet h and the vertical rolls V and horizontal rolls (not shown). First, the rough rolled billet h entered into the rolling mill from its entrance contacts the vertical rolls V with its outer surfaces of the flanges hb. At this moment, the inner surfaces of the flanges hb do not contact the end faces of the horizontal rolls H yet, with the result that the rolling is effected only to reduce the web width by vertical rolls V (zone I).

Second, the inner surfaces of the flanges hb contact the end faces of the horizontal rolls H. At this moment, the reduction of the web width is no longer effected, but the reduction of thicknesses of the flanges hb is performed. Moreover, the barrel surfaces of the horizontal rolls do not contact the surfaces of the web ha under the normal rolling condition with the normal roll diameter (zone J). Next, the barrel surfaces of the horizontal rolls contact the web ha to reduce its thickness and at the same time the reduction of the thicknesses of the flanges hb progresses (zone K). The reduction of web width is effected in the zone I on the entrance side of the rolling mill in this manner.

The reaction of the rolls acting upon the web ha in the zone I will be explained hereinafter. Compression forces Pw are applied to the billet in the directions of the web width by the vertical rolls V because of the reduction of the web width by rolling of the vertical rolls V in the zone I. The reaction forces P caused by the compression forces Pw direct in the directions of the web width in the zone I, while the horizontal rolls do not contact the web ha of the billet yet. In consideration of this condition, it is easy to understand the reason why the buckling and torsion of the web ha is caused.

The zone I is near the zone K where the web is comparatively securely restrained by the vertical rolls V, so that the possibility of the buckling of the web determined only by the reaction forces P is not so high. However, the web ha is subjected to the reaction forces Pf from the vertical rolls V in the rolling direction because only the horizontal rolls are positively driven but vertical rolls are not positively driven in the usual universal mill and only driven by frictional force with the billet advancing in the downstream direction.

In the rolling condition with only the horizontal rolls positively driven as shown in FIG. 13, the rough rolled billet h is subjected to a driving power with its web ha in the zone K where the web ha is rolled to reduce its thickness and with the flanges hb in zones J and K where the flanges hb contacting the horizontal rolls are rolled to reduce their thicknesses. In the zone I, on the other hand, although the outer surfaces of the flanges hb contact the vertical rolls V, the rough rolled billet h is not subjected to any driving power because the vertical rolls do not have any driving force. Consequently, the billet in the zone I is pulled by the part of the billet downstream of the zone I. However, the reduction of web width is being performed in the zone I so that resistance occurs against the pulling force in the rolling direction. Therefore, reaction forces Pf in the rolling direction is applied to the billet from the vertical rolls V as a reaction against the pulling force.

As a result, the web hb in the zone I is subjected to the reaction forces P from the vertical rolls V, which are resultant forces of the reaction forces Pw in the directions of the web width and the reaction forces Pf in the rolling direction. The reaction forces P are higher than the reaction forces Pw and tend to buckle the web upstream of the zone I. Consequently, great compressive forces act upon the web in an area where the web is hardly restrained and remote from the zone K where the web is restrained, with the result that the limit value of the rolling reduction of web width becomes low.

In view of this, according to the invention the vertical rolls V are shifted onto the downstream side of the rolling mill so that the zone I where the reduction of the web width is performed is made to overlap the zone K where the web of the billet is restrained by the horizontal rolls, while the part of web upstream of the zone I and subjected to the reaction forces P is brought into the position as near as possible to the zone K where the web is restrained as shown in FIG. 12. The limit value of the rolling reduction of web width can be greatly enlarged in this manner according to the invention.

The inventors of the present invention have found in their experiments that the vertical rolls should be shifted by preferable distances which are of the order of 3 to 30 mm in actual rolling mills depending upon rolling conditions and dimensions of materials to be rolled. Moreover, while the vertical rolls V are shifted onto the downstream side in the above embodiment, it will be apparent that the horizontal rolls may be shifted onto the upstream side relative to the vertical rolls to obtain the same effect according to the invention.

Figure 14:
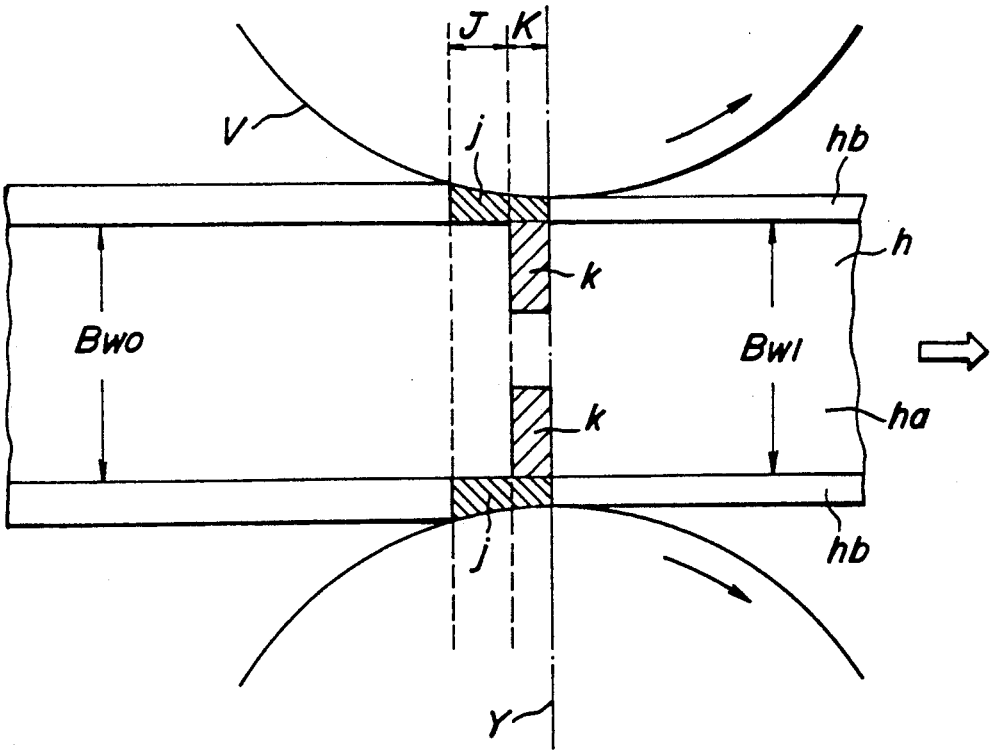
FIG 14 PRIOR ART

FIG. 14 illustrates a rolling state of a normal universal rolling which is not accompanied with the reduction of web width. In this case, there is no zone I because the reduction of web width is not performed. Although there is a zone similar to the zone I, which is caused by correcting the inclination of flanges into positions perpendicular to the web, such a similar zone is out of the question because the reaction forces from the vertical rolls are very much smaller than those in the case being accompanied with the reduction of web width. Consequently, the web ha is free from reaction forces in directions of web width so that there is no problem described above. It is therefore meaningless to shift the vertical rolls in the case shown in FIG. 14.

In connection therewith, Japanese Patent Application Laid-open No. 61-5,601 discloses a rolling method in which vertical rolls of a universal mill are shifted. However, this method does not aim at the rolling accompanied with the reduction of web width. Therefore, this method has only an effect to prevent webs from waving in rolling for producing H-beams having very thin webs.

Moreover, with the methods disclosed in the Japanese Patent Application Laid-open Nos. 2-147,102 and 2-147,112, thicknesses of flanges are not reduced during the reduction of the web width. Therefore, webs are likely to buckle, while horizontal rolls have little effect of preventing the buckling of the webs. As a result, limit values of reduction of web width are very low to an extent prohibiting practical use of these methods.

EXAMPLE 1

H-beams of typical nominal dimensions H750×200, H600×200 and H450×200 having various web thicknesses of 6 to 16 mm were produced by rolling in a manner reducing web widths. Rolling conditions of the produced H-beams were inspected.

Figure 15:
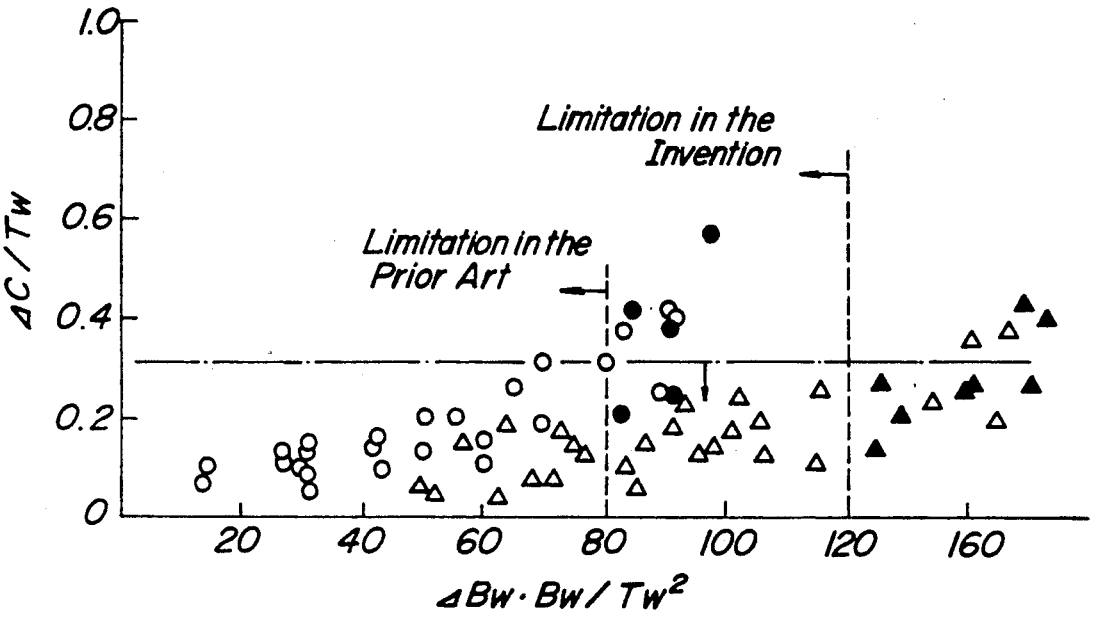
FIG. 15 is a graph illustrating results of an investigation on occurrence limits of defects in shape and surface of billets for producing H-beams.

The results are shown in FIG. 15 having the abscissa indicating $\Delta Bw \cdot Bw/Tw$ and the ordinate indicating $\Delta C/Tw$, where Tw (mm) is web thickness before finishing rolling, Bw (mm) is inner web width, $\Delta Bw$ is rolling reduction of inner web width, and $\Delta C/Tw$ is increase of deflection of web center. In FIG. 15, marks ○ and indicate the results of the prior art methods, while marks Δ and indicate the results of the method according to the invention whose vertical rolls were 20 mm shifted onto the downstream side. The marks and show the fact that flaws occurred in web surfaces, and marks ○ and Δ show flawless surfaces of webs.

As can be seen from FIG. 15, as the values of the abscissa are larger or the inner web width itself and the rolling reduction of inner web width are increased, the deflection of the web center increases as an exponential function and at the same time the possibility of occurrence of flaws in web surfaces increases. In the method according to the invention, however, the deflection of the web center and the possibility of occurrence of flaws are remarkably reduced in comparison with those in the prior art methods with respect to the same values of the abscissa.

In the case that the thickness of products is 6 mm which is thinnest in recent rolled H-beams and the deflection of the web center is limited to ±2 mm which is severer than those in JIS 63192 of H-beams for buildings, the limitation of $\Delta C/Tw$ in ordinate in FIG. 15 is 0.33. Moreover, in order to prevent the flaws in web surfaces in the prior art methods, the limitation of $\Delta Bw \cdot Bw/Tw^2$ in abscissa in FIG. 15 is 80. Namely, the maximum rolling reduction $\Delta Bwmax$ of inner web width is given by an equation of $\Delta Bwmax = 80 \cdot Tw^2/Bw$. On the other hand, the limitation of $\Delta Bw \cdot Bw/Tw^2$ is of the order of 120 according to the invention. Therefore, the maximum rolling reduction $\Delta Bmax$ of inner web width is given by an equation of $\Delta Bwmax = 120 \cdot Tw^2/Bw$. Consequently, according to the present invention the maximum rolling reduction of inner web width can be increased about 1.3 times those of the prior art.

In this embodiment, the horizontal rolls of the finishing mills are positively driven and the vertical rolls are idlers and driven by movements of the billets. However, this method is applicable to a finishing mill whose vertical rolls are driven and the horizontal rolls are idlers or both the vertical and horizontal rolls are driven, so long as the rolling is accompanied with reduction of inner web widths. Moreover, in this embodiment, adjustable width rolls which are known as disclosed, for example, in Japanese Patent Application Laid-open No. 1-317,607 are used as horizontal rolls provided for rolling H-beams of various sizes. However, it is of course possible to use horizontal rolls which are not adjustable in width, so long as their widths are narrower than inner web widths of rough rolled billets and vertical rolls have a roll gap less than web widths of the rough rolled billets to reduce the inner web widths of the billets.

With a universal mill, it is common practice that only horizontal rolls are positively driven and vertical rolls are driven by movement of billet being rolled as described above. It results from the fact that if the vertical rolls are positively driven, driving means becomes complicated so that roll changing operation to be frequently effected in rolling operation becomes imperatively troublesome, and positive driving of the vertical rolls brings about little advantage. The inventors of the present invention found in various experiments that it is very effective to drive vertical rolls of a universal mill positively in order to increase rolling reduction of inner web widths in universal rolling accompanied with reduction of web widths. The invention in the second aspect of this application resides in the above discovery.

In the second aspect of the invention, particularly in an embodiment, a billet rolled in rough rolling is rolled by a universal finishing mill whose both vertical rolls and horizontal rolls are positively driven.

It has been clarified in the above explanation referring to FIG. 13, that great compressive forces act upon the web at the zone I where the web is not restrained to buckle the web upstream of the zone I, and such compressive forces result from the reaction forces Pf caused by the vertical rolls driven by the movement of the billet.

Figure 16:
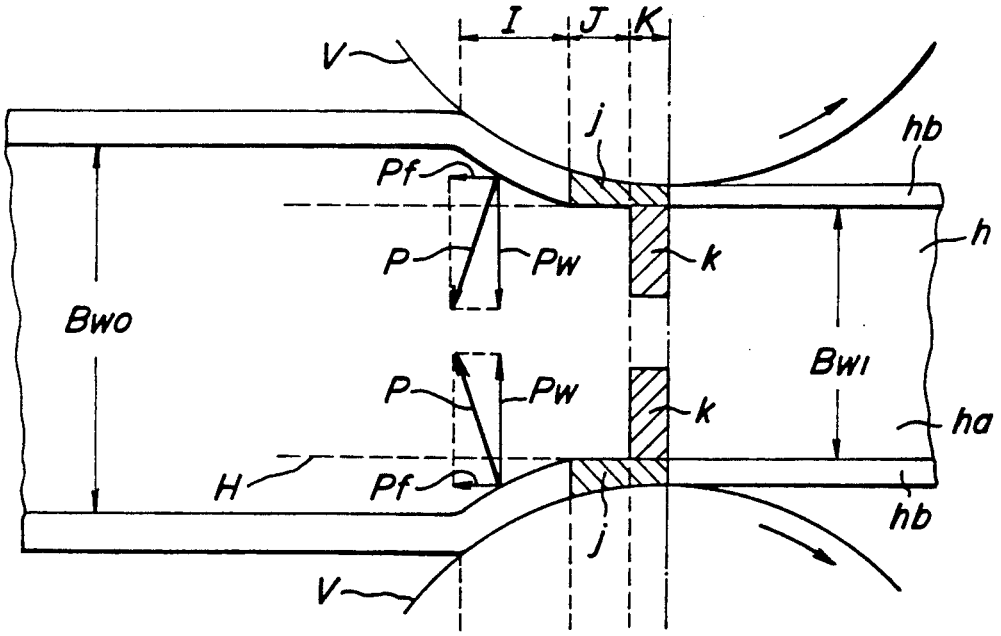
FIG. 16 is an explanatory view for describing the rolling method of producing H-beams according to another aspect of the invention.

Referring to FIG. 16, according to the invention the vertical rolls of the universal mill are positively driven so that the flanges hb and the web ha of a billet h are positively driven to reduce the reaction forces Pf considerably. As a result, the limit value of rolling reduction of web widths can be greatly enlarged. Therefore, H-beams of various sizes can be rolled without increasing the number of rolling passes, and H-beams of constant web widths can be produced by adjusting rolling reduction of web widths even if widths of rolling rolls are changed due to wear of the rolls caused by increase of the number of rolled billets.

In carrying out this invention, it is preferable to set circumferential speeds of vertical rolls substantially equal to those of horizontal speeds.

EXAMPLE 2

H-beams of typical nominal dimensions H750×200, H600×200 and H450×200 having various web thicknesses of 6 to 16 mm were produced by rolling in a manner reducing web widths. Rolling conditions of the produced H-beams were inspected.

Figure 17:
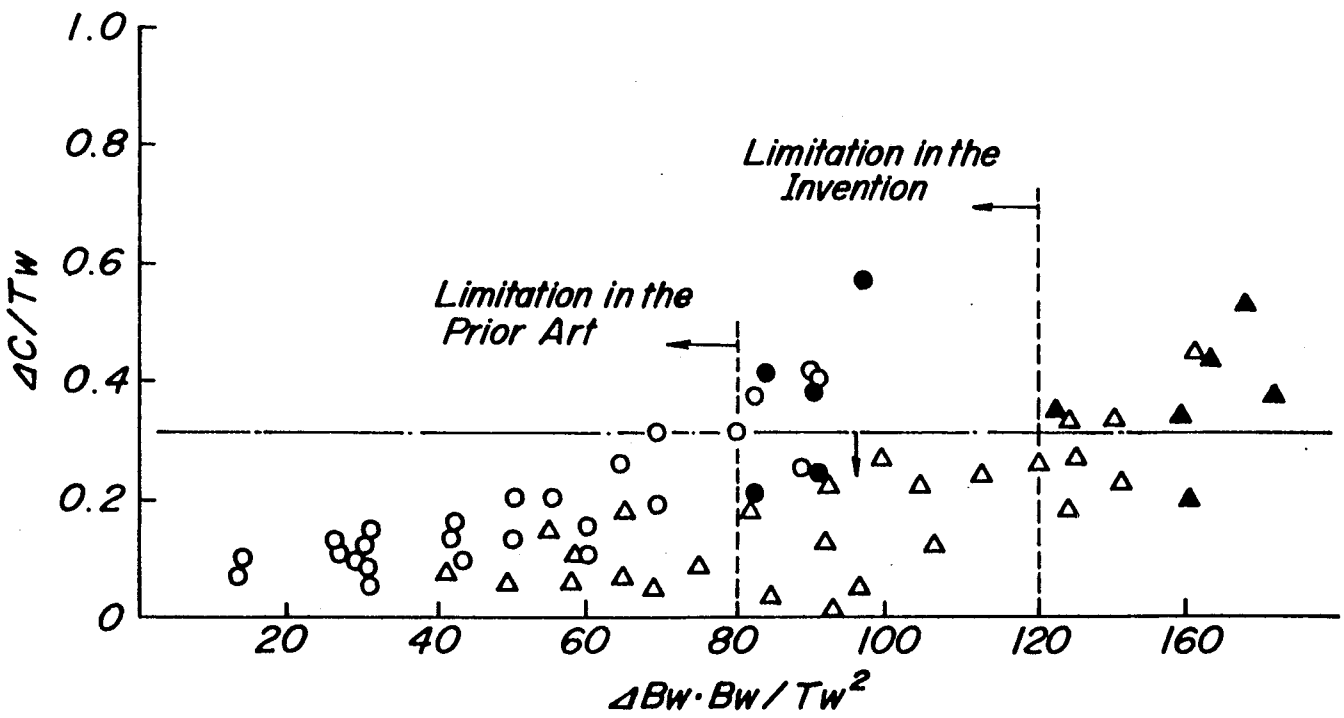
FIG. 17 is a graph illustrating results of another investigation on occurrence limits of defects in shape and surface of billets for producing H-beams.

The results are shown in FIG. 17 having the abscissa indicating $\neq Bw \cdot Bw/Tw$ and the ordinate indicating $\Delta C/Tw$ which are similar to those in Example 1 in FIG. 15. Marks ○ and indicate the results of the prior art methods wherein horizontal rolls were positively driven without positively driving vertical rolls, while marks Δ and indicate the results of the method according to the invention whose horizontal and vertical rolls were positively driven at substantially equal circumferential speeds. The marks and show the fact that flaws occurred in web surfaces, and marks ○ and Δ show flawless surfaces of webs.

As can be seen from FIG. 17, in the method according to the invention, the deflection of the web center and the possibility of occurrence of flaws are remarkably reduced in comparison with those in the prior art methods with respect to the same values of the abscissa.

In the case that the thickness of products is 6 mm which is thinnest in recent rolled H-beams and the deflection of the web center is limited to ±2 mm which is severer than those in JIS 63192 of H-beams for buildings, the limitation of $\Delta C/Tw$ in ordinate in FIG. 17 is 0.33. Moreover, in order to prevent the flaws in web surfaces in the prior art methods, the limitation of $\Delta Bw \cdot Bw/Tw^2$ in abscissa in FIG. 17 is 80. Namely, the maximum rolling reduction $\Delta Bwmax$ of inner web width is given by an equation of $\Delta Bwmax = 80 \cdot Tw^2/Bw$ On the other hand, the limitation of $\Delta Bw \cdot Bw/Tw$is of the order of 120 according to the invention. Therefore, the maximum rolling reduction $\Delta Bwmax$ of inner web width is given by an equation of $\Delta Bwmax = 120 \cdot Tw^2/Bw$. Consequently, according to the present invention the maximum rolling reduction of inner web width can be increased about 1.5 times those of the prior art.

In this embodiment, the horizontal rolls and the vertical rolls of the universal finishing mill are simultaneously positively driven. However, this method is applicable to a finishing mill whose vertical rolls are positively driven and the horizontal rolls are not positively driven, so long as the rolling is accompanied with reduction of inner web widths. Moreover, in this embodiment, adjustable width rolls which are known as disclosed, for example, in Japanese Patent Application Laid-open No. 1-317,607 are used as horizontal rolls provided for rolling H-beams of various sizes. However, it is of course possible to use horizontal rolls which are not adjustable in width, so long as their widths are narrower than inner web widths of rough rolled billets and vertical rolls have a roll gap less than web widths of the rough rolled billets to reduce the inner web widths of the billets.

While the invention has been particularly shown and described with reference to preferred embodiments thereof, it will be understood by those skilled in the art that the foregoing and other changes in form and details can be made therein without departing from the spirit and scope of the invention

What is claimed is:

1. A method of producing an H-beam by finishing rolling a steel billet rolled in rough rolling and having a web and flanges by a universal finishing mill having a pair of vertical rolls embracing the flanges of the billet on both sides and a pair of horizontal rolls having widths less than an inner web width of the steel billet rolled in the rough rolling and embracing the web on upper and lower sides to reduce web width and thicknesses of the flanges of the billet and to correct inclination of the flanges, thereby reducing and adjusting an inner web width of the H-beam, wherein the billet is rolled by the universal finishing mill in a state such that axes of the pair of vertical rolls are shifted downstream of axes of the pair of horizontal rolls into a position within a range where reduction of the web width and the thicknesses of the flanges are simultaneously effected.

2. The method as set forth in claim 1, wherein the axes of the pair of vertical rolls are shifted 3 to 30 mm onto the downstream side of the axes of the pair of horizontal rolls.

3. The method as set forth in claim 1, wherein the axes of the pair of horizontal rolls are shifted upstream of the axes of the pair of vertical rolls.

4. The method as set forth in claim 1, wherein both the pair of vertical rolls and the pair of horizontal rolls are positively driven.

5. The method as set forth in claim 4, wherein the pair of vertical rolls are driven so that an outer peripheral speed is substantially equal to that of the pair of horizontal rolls.

6. A method of producing an H-beam by finishing rolling a steel billet rolled in rough rolling and having a web and flanges by a universal finishing mill having a pair of vertical rolls embracing the flanges of the billet on both sides and a pair of horizontal rolls having widths less than an inner web width of the steel billet rolled in the rough rolling and embracing the web on upper and lower sides to reduce web width and thicknesses of the flanges of the billet and to correct inclination of the flanges, thereby reducing and adjusting an inner web width of the H-beam, wherein the pair of vertical rolls of the universal finishing mill are positively driven in a state such that axes of the pair of vertical rolls are shifted downstream of axes of the pair of horizontal rolls into a position within a range where reduction of the web width and the thicknesses of the flanges are simultaneously effected.

* * * * *